US010047578B2

(12) United States Patent
Lovorn et al.

(10) Patent No.: US 10,047,578 B2
(45) Date of Patent: Aug. 14, 2018

(54) PRESSURE CONTROL IN DRILLING OPERATIONS WITH CHOKE POSITION DETERMINED BY CV CURVE

(75) Inventors: James R. Lovorn, Tomball, TX (US); Nancy S. Davis, Irving, TX (US); Cody N. Butler, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 708 days.

(21) Appl. No.: 14/412,631

(22) PCT Filed: Jul. 2, 2012

(86) PCT No.: PCT/US2012/045234

§ 371 (c)(1),
(2), (4) Date: Mar. 18, 2015

(87) PCT Pub. No.: WO2014/007797

PCT Pub. Date: Jan. 9, 2014

(65) Prior Publication Data

US 2015/0240579 A1 Aug. 27, 2015

(51) Int. Cl.
*E21B 21/08* (2006.01)
*E21B 21/10* (2006.01)
(Continued)

(52) U.S. Cl.
CPC ..... *E21B 21/08* (2013.01); *E21B 21/10* (2013.01); *E21B 34/02* (2013.01); *E21B 47/06* (2013.01)

(58) Field of Classification Search
None
See application file for complete search history.

(56) References Cited

U.S. PATENT DOCUMENTS 4,253,530 A 3/1981 Sharki et al.
8,352,087 B2 * 1/2013 Yli-Koski ..... G05B 13/04 700/13

(Continued)

FOREIGN PATENT DOCUMENTS

CN 201593387 U 9/2010
CN 102454372 A 5/2012

(Continued)

OTHER PUBLICATIONS

International Search and Written Report dated Mar. 15, 2013 for PCT Application No. PCT/US2012/045234 filed on Jul. 2, 2012.(13 p.).

*Primary Examiner* — Shane Bomar
(74) *Attorney, Agent, or Firm* — Chamberlain Hrdlicka

(57) ABSTRACT

A method of controlling pressure in a wellbore can include determining a desired position for a choke, the determining being based on a Cv curve for the choke, and adjusting the choke to the desired position, thereby producing a desired backpressure. A wellbore drilling system can include a choke which variably restricts flow of fluid from the wellbore, and a control system which compares actual and desired wellbore pressures and, in response to a difference between the actual and desired wellbore pressures, adjusts the choke to a predetermined position which corresponds to a desired Cv of the choke. A method of controlling pressure in a wellbore can include comparing an actual wellbore pressure to a desired wellbore pressure and, in response to a difference between the actual and desired wellbore pressures, adjusting a choke to a predetermined position, the predetermined position corresponding to a desired Cv of the choke.

25 Claims, 5 Drawing Sheets

(51) Int. Cl.
*E21B 34/02* (2006.01)
*E21B 47/06* (2012.01)

(56) References Cited

U.S. PATENT DOCUMENTS

| | | | | |
|---|---|---|---|---|
| 8,490,719 | B2 * | 7/2013 | Duhe | E21B 21/08 166/250.07 |
| 2006/0207795 | A1 | 9/2006 | Kinder et al. | |
| 2007/0168056 | A1 * | 7/2007 | Shayegi | G05B 13/048 700/48 |
| 2009/0125154 | A1 * | 5/2009 | Yli-Koski | G05D 7/0635 700/282 |
| 2010/0288507 | A1 * | 11/2010 | Duhe | E21B 21/08 166/370 |
| 2011/0094607 | A1 * | 4/2011 | Elliott | F16K 47/08 137/511 |
| 2011/0139464 | A1 * | 6/2011 | Henderson | E21B 21/01 166/370 |
| 2011/0139506 | A1 * | 6/2011 | Lovorn | E21B 21/10 175/25 |
| 2011/0290562 | A1 | 12/2011 | Standifird et al. | |
| 2016/0102511 | A1 * | 4/2016 | Brana | E21B 7/00 175/25 |
| 2016/0298401 | A1 * | 10/2016 | Cotten | E21B 44/00 |
| 2017/0328151 | A1 * | 11/2017 | Dillard | E21B 21/08 |

FOREIGN PATENT DOCUMENTS

| | | | |
|---|---|---|---|
| EP | 0604134 | A1 | 6/1994 |
| EP | 1227215 | A2 | 7/2002 |
| WO | 2007141386 | A1 | 12/2007 |
| WO | 2010071656 | A1 | 6/2010 |

* cited by examiner

PRESSURE CONTROL IN DRILLING OPERATIONS WITH CHOKE POSITION DETERMINED BY CV CURVE

TECHNICAL FIELD

This disclosure relates generally to equipment utilized and operations performed in conjunction with a subterranean well and, in one example described below, more particularly provides for pressure control in drilling operations, with a choke position being determined by a Cv curve.

BACKGROUND

It is known to control pressure in a wellbore by controlling a level of pressure applied to the wellbore at or near the surface. This applied pressure can be from one or more of a variety of sources, such as, backpressure applied by a choke in a mud return line, pressure applied by a dedicated backpressure pump, and/or pressure diverted from a standpipe line to the mud return line.

Therefore, it will be appreciated that improvements are continually needed in the art of controlling pressure in drilling operations.

DETAILED DESCRIPTION

Figure 1:
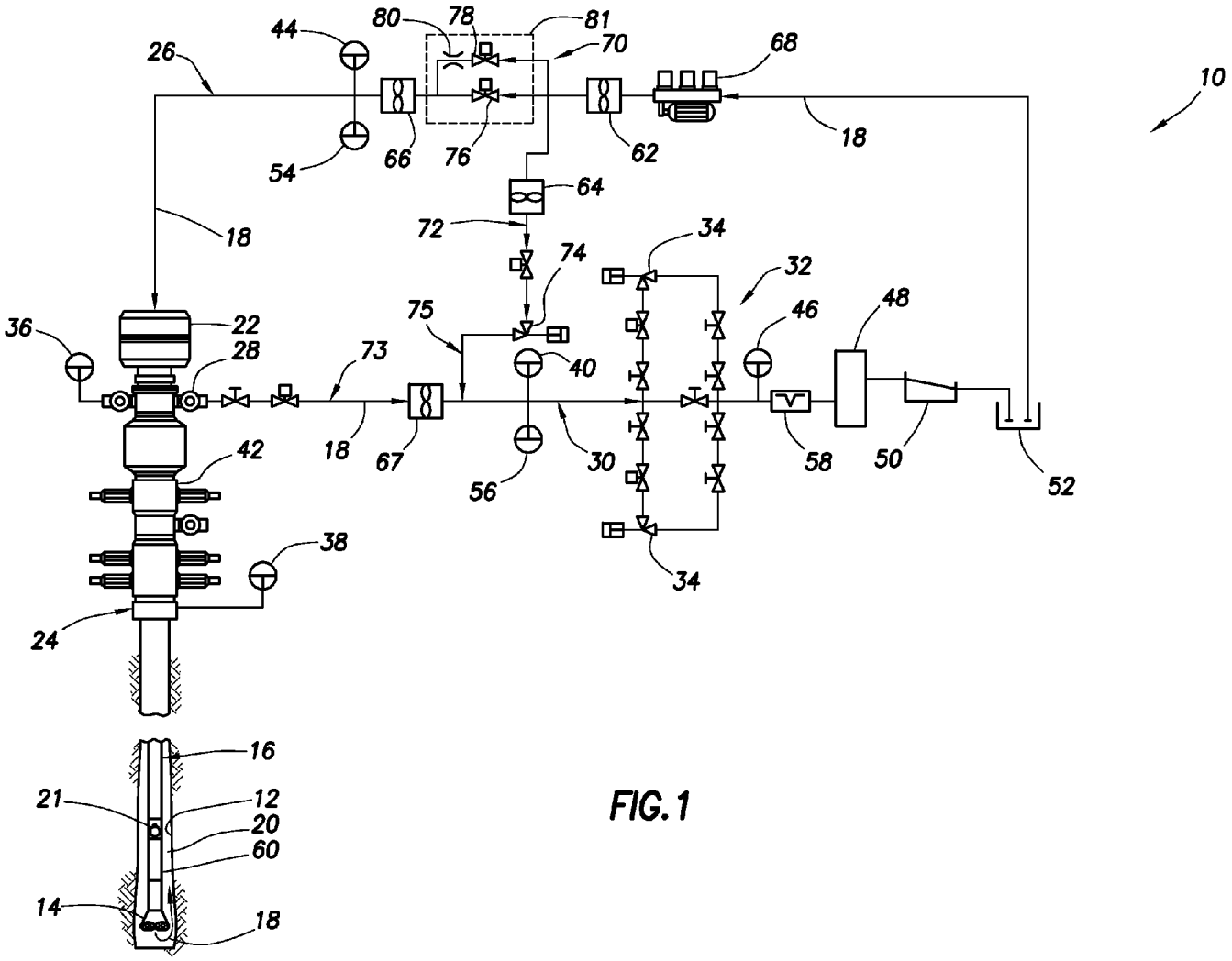
FIG. 1 is a representative partially cross-sectional view of a well drilling system and associated method which can embody principles of this disclosure.

Representatively illustrated in FIG. 1 is a well drilling system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of wellbore pressure is very important in managed pressure drilling, and in other types of drilling operations. Preferably, the wellbore pressure is precisely controlled to prevent excessive loss of fluid into the earth formation surrounding the wellbore 12, undesired fracturing of the formation, undesired influx of formation fluids into the wellbore, etc.

In typical managed pressure drilling, it is desired to maintain the wellbore pressure just slightly greater than a pore pressure of the formation penetrated by the wellbore, without exceeding a fracture pressure of the formation. This technique is especially useful in situations where the margin between pore pressure and fracture pressure is relatively small.

In typical underbalanced drilling, it is desired to maintain the wellbore pressure somewhat less than the pore pressure, thereby obtaining a controlled influx of fluid from the formation. In typical overbalanced drilling, it is desired to maintain the wellbore pressure somewhat greater than the pore pressure, thereby preventing (or at least mitigating) influx of fluid from the formation.

Nitrogen or another gas, or another lighter weight fluid, may be added to the drilling fluid 18 for pressure control. This technique is useful, for example, in underbalanced drilling operations.

In the system 10, additional control over the wellbore pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through mud return lines 30, 73 to a choke manifold 32, which includes redundant chokes 34 (only one of which might be used at a time). Backpressure is applied to the annulus 20 by variably restricting flow of the fluid 18 through the operative choke(s) 34.

The greater the restriction to flow through the choke 34, the greater the backpressure applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20. Hydraulics models can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the mud return lines 30, 73 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from all available sensors can be useful to the hydraulics models in determining what the pressure applied to the annulus 20 should be during the drilling operation.

Other sensor types may be used, if desired. For example, it is not necessary for the flowmeter 58 to be a Coriolis flowmeter, since a turbine flowmeter, acoustic flowmeter, or another type of flowmeter could be used instead.

In addition, the drill string 16 may include its own sensors 60, for example, to directly measure downhole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of wired or wireless telemetry (acoustic, pressure pulse, electromagnetic, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26. The fluid 18 then circulates downward through the drill string 16, upward through the annulus 20, through the mud return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the downhole pressure, unless the fluid 18 is flowing through the choke. In conventional overbalanced drilling operations, a lack of fluid 18 flow will occur, for example, whenever a connection is made in the drill string 16 (e.g., to add another length of drill pipe to the drill string as the wellbore 12 is drilled deeper), and the lack of circulation will require that downhole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used.

When fluid 18 is not circulating through drill string 16 and annulus 20 (e.g., when a connection is made in the drill string), the fluid is flowed from the pump 68 to the choke manifold 32 via a bypass line 72, 75. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20 (for example, in typical managed pressure drilling).

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional piping at the rig site, the effect on the annulus pressure would be essentially the same as connecting the bypass line 75 and the mud return line 30 to the common line 73. Thus, it should be appreciated that various different configurations of the components of the system 10 may be used, and still remain within the scope of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Since the rate of flow of the fluid 18 through each of the standpipe and bypass lines 26, 72 is useful in determining how wellbore pressure is affected by these flows, the flowmeters 64, 66 are depicted in FIG. 1 as being interconnected in these lines.

However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

In the FIG. 1 example, a bypass flow control device 78 and flow restrictor 80 may be used for filling the standpipe line 26 and drill string 16 after a connection is made in the drill string, and for equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 preserve the use of the flow control device 76. The flow control devices 76, 78 are at times referred to collectively below as though they are the single flow control device 81, but it should be understood that the flow control device 81 can include the individual flow control devices 76, 78.

Figure 2:
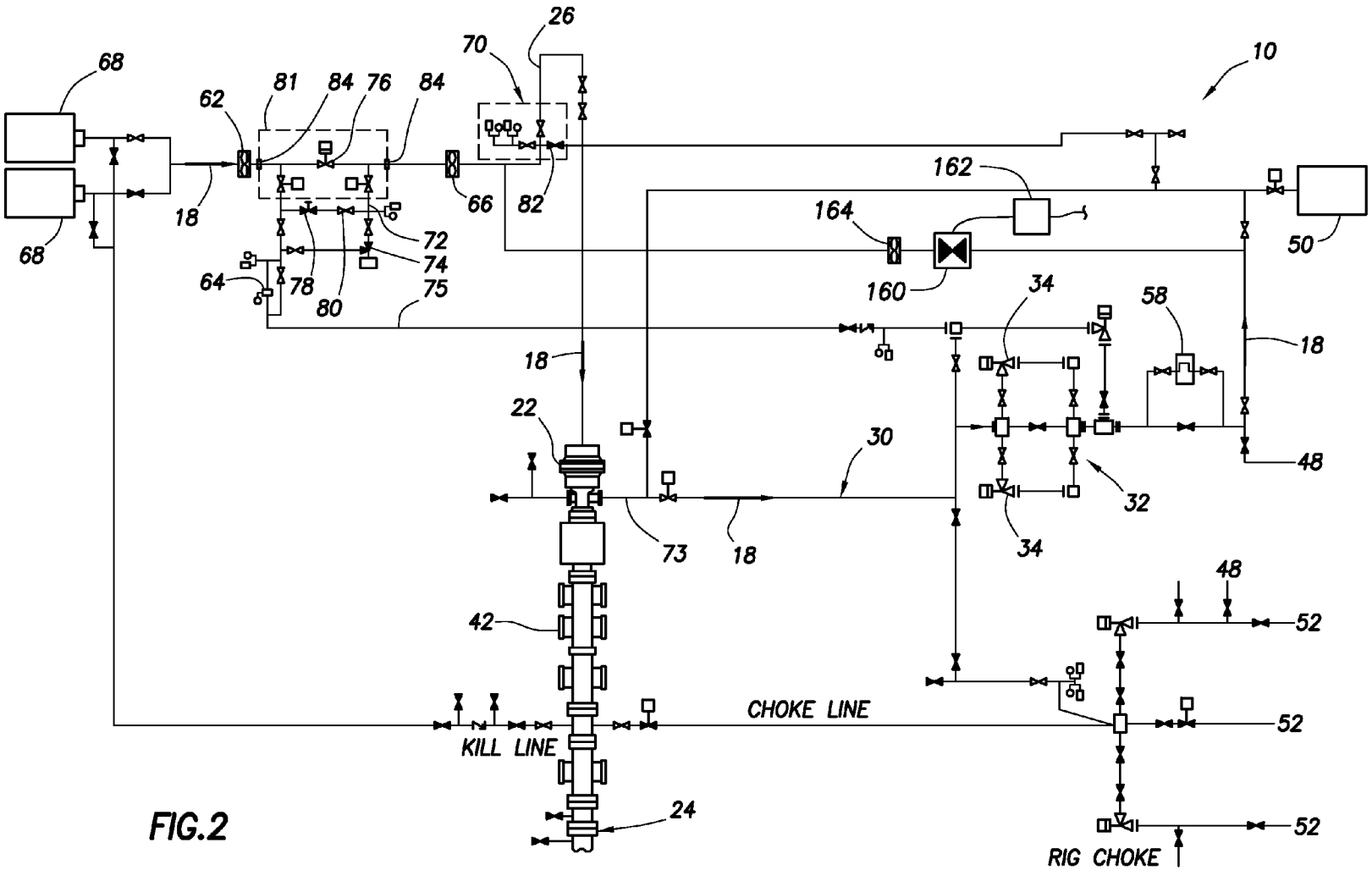
FIG. 2 is a representative schematic view of another example of the well drilling system and method.

Another example is representatively illustrated in FIG. 2. In this example, the flow control device 76 is connected upstream of the rig's standpipe manifold 70. This arrangement has certain benefits, such as, no modifications are needed to the rig's standpipe manifold 70 or the line between the manifold and the kelley, the rig's standpipe bleed valve 82 can be used to vent the standpipe 26 as in normal drilling operations (no need to change procedure by the rig's crew), etc.

The flow control device 76 can be interconnected between the rig pump 68 and the standpipe manifold 70 using, for example, quick connectors 84 (such as, hammer unions, etc.). This will allow the flow control device 76 to be conveniently adapted for interconnection in various rigs' pump lines.

Figure 3:
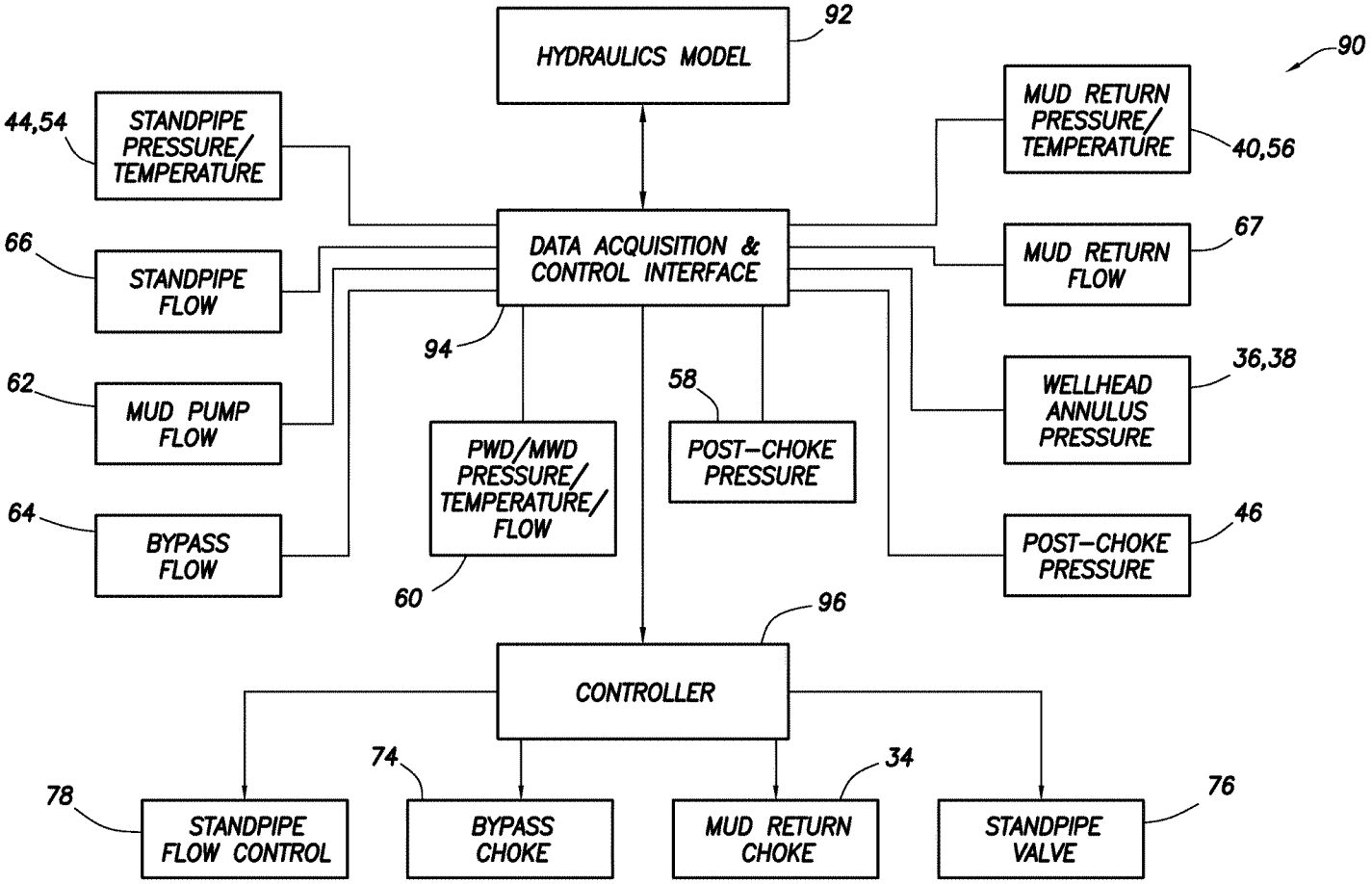
FIG. 3 is a representative schematic view of a pressure and flow control system which may be used with the system and method of FIGS. 1 & 2.

A specially adapted fully automated flow control device 76 (e.g., controlled automatically by the controller 96 depicted in FIG. 3) can be used for controlling flow through the standpipe line 26, instead of using the conventional standpipe valve in a rig's standpipe manifold 70. The entire flow control device 81 can be customized for use as described herein (e.g., for controlling flow through the standpipe line 26 in conjunction with diversion of fluid 18 between the standpipe line and the bypass line 72 to thereby control pressure in the annulus 20, etc.), rather than for conventional drilling purposes.

In the FIG. 2 example, a remotely controllable valve or other flow control device 160 is optionally used to divert flow of the fluid 18 from the standpipe line 26 to the mud return line 30 downstream of the choke manifold 32, in order to transmit signals, data, commands, etc. to downhole tools (such as the FIG. 1 bottom hole assembly including the sensors 60, other equipment, including mud motors, deflection devices, steering controls, etc.). The device 160 is controlled by a telemetry controller 162, which can encode information as a sequence of flow diversions detectable by the downhole tools (e.g., a certain decrease in flow through a downhole tool will result from a corresponding diversion of flow by the device 160 from the standpipe line 26 to the mud return line 30).

A suitable telemetry controller and a suitable remotely operable flow control device are provided in the GEOSPAN™ system marketed by Halliburton Energy Services, Inc. The telemetry controller 162 can be connected to the INSITE™ system or other acquisition and control interface 94 in the control system 90. However, other types of telemetry controllers and flow control devices may be used in keeping with the scope of this disclosure.

Note that each of the flow control devices 74, 76, 78 and chokes 34 are preferably remotely and automatically controllable to maintain a desired downhole pressure by maintaining a desired annulus pressure at or near the surface. However, any one or more of these flow control devices 74, 76, 78 and chokes 34 could be manually controlled, in keeping with the scope of this disclosure.

A pressure and flow control system 90 which may be used in conjunction with the system 10 and associated methods of FIGS. 1 & 2 is representatively illustrated in FIG. 3. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 3, any or all of them could be combined into a single element, or the functions of the elements could be separated into additional elements, other additional elements and/or functions could be provided, etc.

The hydraulics model 92 is used in the control system 90 to determine a desired annulus pressure at or near the surface to achieve a desired downhole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. It is important to appreciate that the data acquisition and control interface 94 operates to maintain a substantially continuous flow of real-time data from the sensors 44, 54, 66, 62, 64, 60, 58, 46, 36, 38, 40, 56, 67 to the hydraulics model 92, so that the hydraulics model has the information they need to adapt to changing circumstances and to update the desired annulus pressure, and the hydraulics model operates to supply the data acquisition and control interface substantially continuously with a value for the desired annulus pressure.

A suitable hydraulics model for use as the hydraulics model 92 in the control system 90 is REAL TIME HYDRAULICS™ or GB SETPOINT™ marketed by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ marketed by Halliburton Energy Services, Inc. Any suitable data acquisition and control interface may be used in the control system 90 in keeping with the principles of this disclosure.

The controller 96 operates to maintain a desired setpoint annulus pressure by controlling operation of the mud return choke 34 and other devices. For example, the controller 96 may also be used to control operation of the standpipe flow control devices 76, 78 and the bypass flow control device 74.

The controller 96 can, thus, be used to automate the processes of diverting flow of the fluid 18 from the standpipe line 26 to the bypass line 72 prior to making a connection in the drill string 16, then diverting flow from the bypass line to the standpipe line after the connection is made, and then resuming normal circulation of the fluid 18 for drilling. Again, no human intervention may be required in these automated processes, although human intervention may be used if desired, for example, to initiate each process in turn, to manually operate a component of the system, etc.

Data validation and prediction techniques may be used in the system 90 to guard against erroneous data being used, to ensure that determined values are in line with predicted values, etc. Suitable data validation and prediction techniques are described in International Application No. PCT/US11/59743, although other techniques may be used, if desired.

In the past, when an updated desired annulus pressure was transmitted from the data acquisition and control interface 94 to the controller 96, the controller used the desired annulus pressure as a setpoint and controlled operation of the choke 34 in a manner (e.g., increasing or decreasing flow resistance through the choke as needed) to maintain the setpoint pressure in the annulus 20. The choke 34 was closed more to increase flow resistance, or opened more to decrease flow resistance.

Maintenance of the setpoint pressure was accomplished by comparing the setpoint pressure to a measured annulus pressure (such as the pressure sensed by any of the sensors 36, 38, 40), and decreasing flow resistance through the choke 34 if the measured pressure is greater than the setpoint pressure, and increasing flow resistance through the choke if the measured pressure is less than the setpoint pressure. Unfortunately, the adjustment of the choke was typically determined by a proportional integral derivative (PID) controller, and so (depending on the coefficients input to the PID controller, the choke could easily be over- or under-adjusted, or it could take a long time to progress through a number of increments needed to finally position the choke where it should be positioned to maintain the desired annulus pressure.

However, in an example of a method described more fully below, the choke 34 can be positioned where it should be positioned to maintain the desired annulus pressure, with no or minimal increments, without over- or under-adjustment, and without a need for a PID controller. Of course, in other examples, increments may be used, over- or under-adjustment may occur, and a PID controller may be used.

Figure 4:
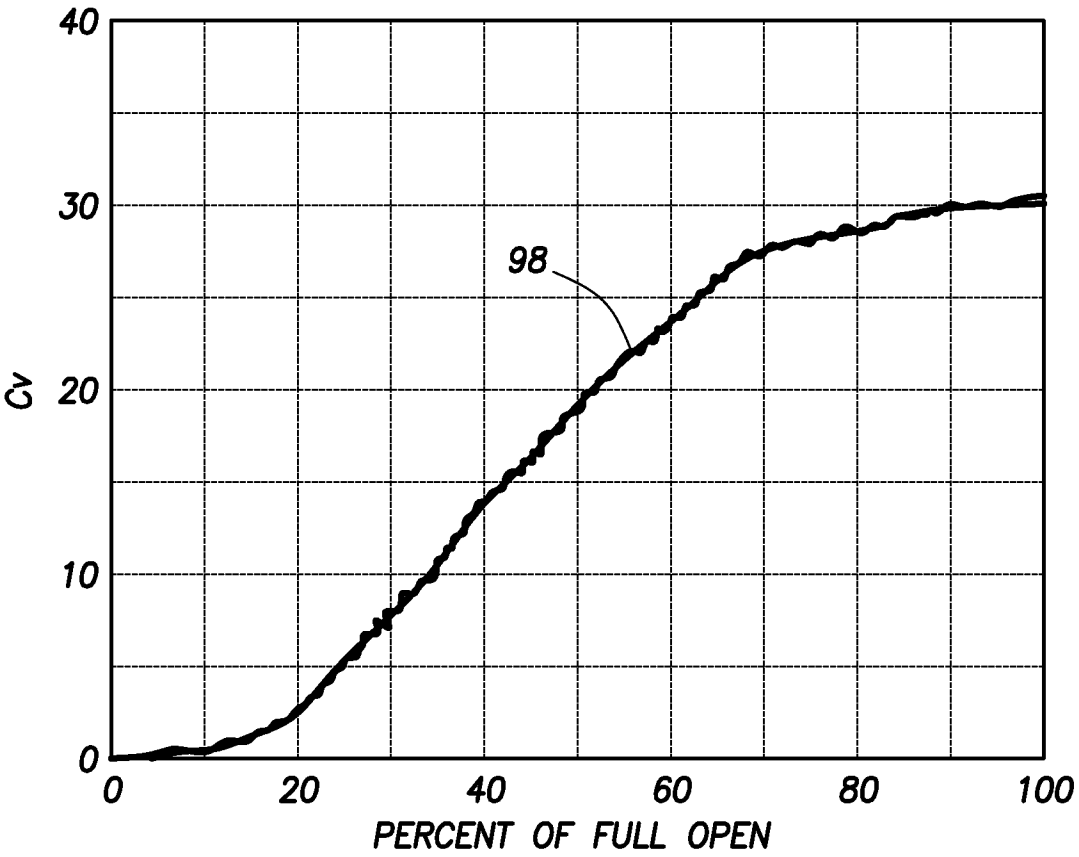
FIG. 4 is a representative Cv curve for a choke which may be used in a drilling operation.

Referring additionally now to FIG. 4, an example of a Cv curve 98 for the choke 34 is representatively illustrated. Cv is a dimensionless valve coefficient which relates differential pressure across a choke to flow of a fluid through the choke. Cv is given by the following equation:

$$Cv=11.7q(\mathrm{SG}/\mathrm{dp})^{1/2} \quad (1)$$

wherein q is flow rate in cubic meters per hour, SG is specific gravity of the fluid, and dp is differential pressure across the choke in kPa.

The FIG. 4 Cv curve 98 relates the choke 34 Cv to its position (expressed in the graph as percent of full open). Note that the Cv curve 98 is for the particular choke 34, and every choke will have a different Cv curve, depending on the characteristics of the choke (size, trim, etc.).

In the system 10 described above, the specific gravity SG of the fluid 18 is known (e.g., from mud logging), and the flow rate q and the differential pressure dp across the choke 34 are readily measured, for example, using the sensors 40, 46, 58, 67. Thus, at any point during the drilling operation, a Cv of the choke 34 can be determined and, knowing the position of the choke, the Cv curve 98 can be calibrated, updated, etc. with this information.

In this manner, the Cv curve 98 for the choke 34 can be continuously or periodically calibrated, so that an updated Cv curve is always available for determining a position of the choke which will produce a desired pressure in the annulus 20 upstream of the choke. This determination can be made when it is indicated that the measured annulus pressure is not the same as (or acceptably close to) the desired annulus pressure.

Figure 5:
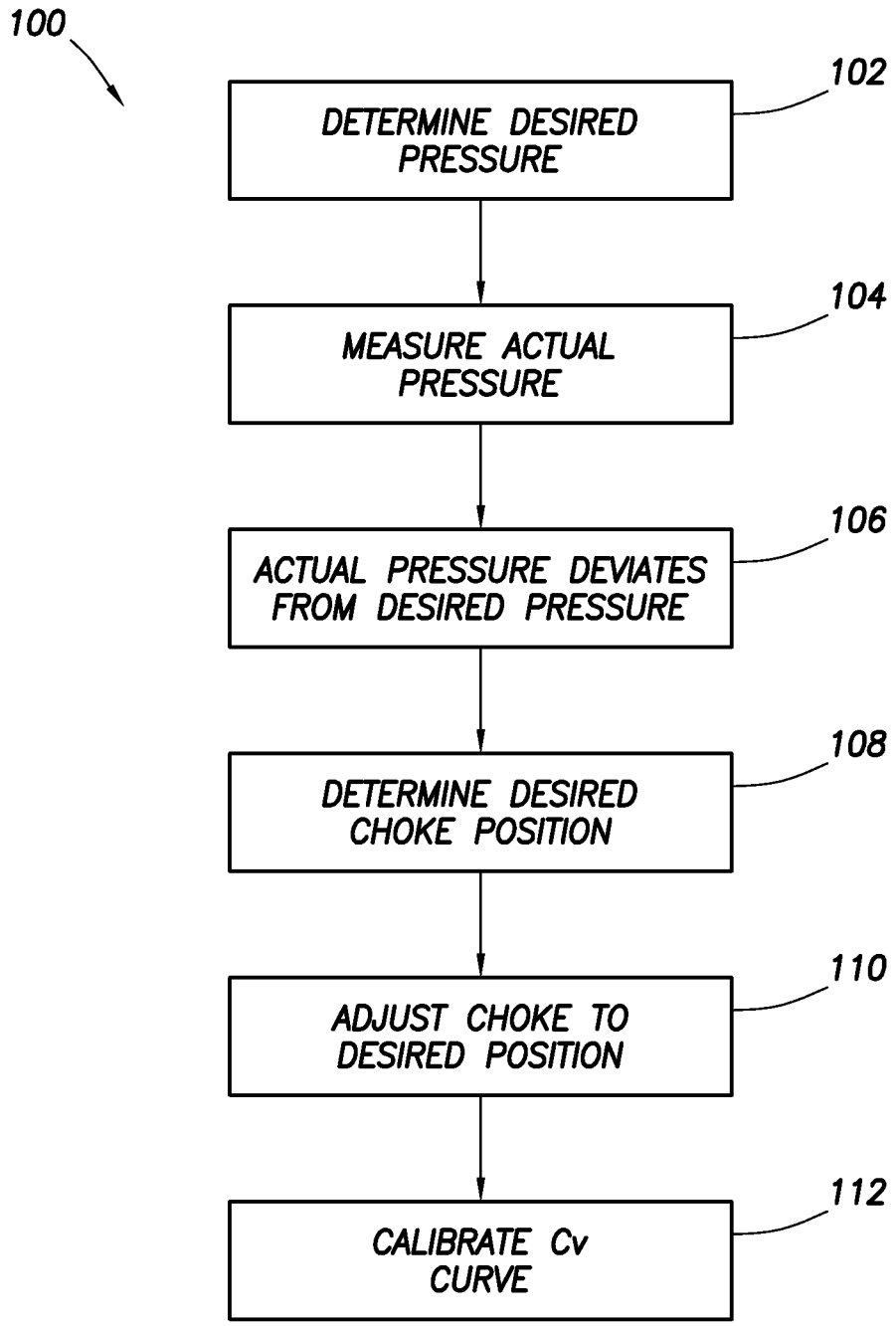
FIG. 5 is a representative flowchart for an example of a wellbore pressure control method.

Referring additionally now to FIG. 5, an example of a method 100 of controlling wellbore pressure during a drilling operation is representatively illustrated in flowchart form. The method 100 may be used with the well drilling system 10 described above, or the method could be used with any other system.

In step 102, a desired pressure is determined. Using the control system 90 described above, the hydraulics model 92 makes the determination of the desired pressure, based at least in part on data supplied by the data acquisition and control interface 94. The desired pressure may be a desired annulus pressure at or near the surface, or it could be a pressure at another location in the wellbore 12 (such as, at a casing shoe, at a bottom of the wellbore, at a sensitive zone, etc.).

In step 104, actual pressure is measured. The measurement may be made by any of the pressure sensors 36, 38, 40, 60 described above, or by any other pressure sensors. If an annulus pressure is determined in step 102, then at least an actual annulus pressure measurement will be made in step 104.

In step 106, the desired and measured pressures are compared, and an adjustment to the choke 34 is indicated if there is a significant difference between the desired and measured pressures (e.g., above a predetermined threshold level). This comparison can be made, for example, by the hydraulics model 92 or the data acquisition and control interface 94.

In step 108, a desired choke 34 position is determined. Equation 1 can be used to calculate a desired Cv of the choke 34 for a desired differential pressure dp across the choke, the flow rate q and the fluid 18 specific gravity SG. The Cv curve 98 for the choke 34 can then be consulted for the choke 34 position which corresponds to the desired Cv. For this purpose, the Cv curve 98 could be available to the hydraulics model 92 and/or data acquisition and control interface 94 as a curve fit equation, as a look-up table, or in any other form.

In step 110, the choke 34 is adjusted to the position which corresponds to the desired Cv. For example, the choke 34 can be adjusted to a certain percentage of full open, to a specific position of a choke component (such as a stem, trim component, etc.), or otherwise to a position which corresponds to the Cv which will produce a desired backpressure in the mud return line 30 and, thus, in the wellbore 12.

Limits can be placed on the choke 34 adjustment in step 110. For example, the amount of adjustment can be limited (e.g., no more than 5% at a time) to avoid sudden pressure and flow changes that could promote instability, the range of adjustment can be limited to a useful operating range of the choke 34, etc.

In the control system 90, the data acquisition and control interface 94 transmits to the controller 96 a desired position of the choke 34, and the controller operates the choke as appropriate (e.g., displacing a trim component of the choke, etc.). Thus, the choke 34 is adjusted to a particular predetermined position, based on a desired Cv of the choke to produce a desired backpressure in the mud return line 30.

Step 112 is included to emphasize that, preferably, the Cv curve 98 is calibrated in the method 100. This calibration can be performed at any frequency, but is preferably performed often enough to account for choke 34 trim wear, changes in fluid 18 density, changes in flow rate, changes in fluid type or phase, etc. Preferably, when the desired choke 34 position is determined in step 108, a calibrated Cv curve 98 is available for the determination.

It may now be fully appreciated that the above disclosure provides significant advancements to the art of controlling pressure in drilling operations. The method 100 can be used to position the choke 34 as needed to maintain a desired wellbore pressure. In an example described above, the choke 34 can be positioned directly at the position which will produce the desired wellbore pressure, without making incremental adjustments, and without over- or under-adjustment.

A method 100 of controlling pressure in a wellbore 12 is described above. In one example, the method 100 comprises: determining a desired position for a choke 34, the determining being based on a Cv curve 98 for the choke 34, and adjusting the choke 34 to the desired position, thereby producing a desired backpressure in the wellbore 12.

The Cv curve 98 relates a Cv of the choke 34 to a choke position.

The determining step may be performed in response to there being a difference between an actual wellbore pressure and a desired wellbore pressure. The wellbore pressure may be pressure in an annulus 20 at or near the earth's surface, or pressure at a particular location in the wellbore 12.

The adjusting step may be performed automatically in response to there being a predetermined level of difference between an actual wellbore pressure and a desired wellbore pressure.

The method 100 can also include calibrating the Cv curve 98. The calibrating may be performed during a drilling operation, with sensor measurements of flow rate and pressure, and/or periodically.

The determining step can comprise determining the desired backpressure, calculating a desired Cv corresponding to the desired backpressure, and determining the desired position which corresponds to the desired Cv.

Adjusting the choke 34 can include transmitting to a programmable logic controller 96 an indication of the desired position of the choke 34.

Also described above is a system 10 for drilling a wellbore 12. In one example, the system 10 can include a choke 34 which variably restricts flow of fluid 18 from the wellbore 12, and a control system 90 which compares an actual wellbore pressure to a desired wellbore pressure and, in response to a difference between the actual and desired wellbore pressures, adjusts the choke 34 to a predetermined position which corresponds to a desired Cv of the choke 34.

Another method of controlling pressure in a wellbore 12 is described above. The method can include comparing an actual wellbore pressure to a desired wellbore pressure, and in response to a difference between the actual and desired wellbore pressures, adjusting a choke 34 to a predetermined position, the predetermined position corresponding to a desired Cv of the choke 34. The predetermined position can be related to the desired Cv of the choke 34 by a Cv curve 98.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of controlling pressure in a wellbore, the method comprising:

determining a desired position for a choke, the determining being based on a Cv curve for the choke;

adjusting the choke to the desired position, thereby producing a desired backpressure in the wellbore; and calibrating a second Cv curve of the choke based on changes to a fluid condition through the choke, changes to the choke, or any combination thereof.

2. The method of claim 1, wherein the Cv curve relates a Cv of the choke to a choke position.

3. The method of claim 1, wherein the determining is performed in response to there being a difference between an actual wellbore pressure and a desired wellbore pressure.

4. The method of claim 1, wherein the adjusting is performed automatically in response to there being a predetermined level of difference between an actual wellbore pressure and a desired wellbore pressure.

5. The method of claim 1, further comprising calibrating the Cv curve.

6. The method of claim 5, wherein the calibrating is performed during a drilling operation.

7. The method of claim 5, wherein the calibrating is performed with sensor measurements of flow rate and pressure.

8. The method of claim 5, wherein the calibrating is performed periodically.

9. The method of claim 1, wherein the determining further comprises determining the desired backpressure, calculating a desired Cv corresponding to the desired backpressure, and determining the desired position which corresponds to the desired Cv.

10. The method of claim 1, wherein adjusting the choke further comprises transmitting to a programmable logic controller an indication of the desired position of the choke.

11. A system for drilling a wellbore, the system comprising:

a choke which variably restricts flow of fluid from the wellbore; and a control system which compares an actual wellbore pressure to a desired wellbore pressure and, in response to a difference between the actual and desired wellbore pressures, adjusts the choke to a predetermined position which corresponds to a desired Cv of the choke, wherein the predetermined position is related to the desired Cv by a Cv curve for the choke, and the control system calibrates the Cv curve and a second Cv curve based on changing conditions within the wellbore.

12. The well drilling system of claim 11, wherein the Cv curve is calibrated during a drilling operation.

13. The well drilling system of claim 11, wherein the Cv curve is calibrated with sensor measurements of flow rate and pressure.

14. The well drilling system of claim 11, wherein the Cv curve is calibrated periodically.

15. The well drilling system of claim 11, wherein an indication of the predetermined position of the choke is transmitted to a programmable logic controller of the control system.

16. The well drilling system of claim 11, wherein the control system automatically adjusts the choke in response to there being a predetermined level of the difference between the actual wellbore pressure and the desired wellbore pressure.

17. The well drilling system of claim 11, wherein the predetermined position of the choke produces a desired backpressure in a line connected to the wellbore.

18. A method of controlling pressure in a wellbore, the method comprising:

comparing an actual wellbore pressure to a desired wellbore pressure; and in response to a difference between the actual and desired wellbore pressures, adjusting a choke to a predetermined position, the predetermined position corresponding to a desired Cv of the choke, wherein the predetermined position is related to the desired Cv of the choke by a Cv curve calibrating a second Cv curve of the choke based on changes to a fluid flow through the choke.

19. The method of claim 18, wherein the adjusting is performed automatically in response to there being a predetermined level of the difference between the actual wellbore pressure and the desired wellbore pressure.

20. The method of claim 18, wherein the calibrating is performed during a drilling operation.

21. The method of claim 18, wherein the calibrating is performed with sensor measurements of flow rate and pressure.

22. The method of claim 18, wherein the calibrating is performed periodically.

23. The method of claim 18, further comprising determining a desired backpressure to be applied to the wellbore, calculating the desired Cv corresponding to the desired backpressure, and determining a choke position which corresponds to the desired Cv.

24. The method of claim 18, wherein adjusting the choke further comprises transmitting to a programmable logic controller an indication of the predetermined position of the choke.

25. The method of claim 18, wherein adjusting the choke produces a desired backpressure in a line connected to the wellbore.

* * * * *